United States Patent [19]

Suttkus et al.

[11] 4,083,664

[45] Apr. 11, 1978

[54] ROTARY HYDRAULIC DEVICE WITH RETAINING MEANS FOR PUMPING ELEMENT BIASING SPRINGS

[75] Inventors: David John Suttkus, Warren; Jack Warden Garrett, Utica, both of Mich.

[73] Assignee: TRW Inc., Cleveland, Ohio

[21] Appl. No.: 740,035

[22] Filed: Nov. 8, 1976

[51] Int. Cl.[2] ..... F01C 1/00; F03C 3/00; B23P 11/00; F01C 21/00

[52] U.S. Cl. ..... 418/266; 418/252; 29/156.4 R; 29/434; 29/446

[58] Field of Search ..... 418/70, 122, 123, 252, 418/266, 267; 29/156.4 R, 434, 446

[56] References Cited

U.S. PATENT DOCUMENTS

| | | | |
|---|---|---|---|
| 605,585 | 6/1898 | Phillips | 418/266 |
| 868,841 | 10/1907 | Calkins | 418/266 |
| 1,556,315 | 10/1925 | Drennan | 418/266 |
| 1,769,647 | 7/1930 | Press | 418/266 |
| 1,997,350 | 4/1935 | Swan | 418/266 |
| 3,645,647 | 2/1972 | Ciampa et al. | 418/267 |
| 3,765,379 | 10/1973 | Thomas | 418/267 |
| 3,797,977 | 3/1974 | Carlson | 418/267 |

*Primary Examiner*—John J. Vrablik

[57] ABSTRACT

An improved hydraulic device includes a rotor which is circumscribed by a cam surface. A series of peripheral slots are formed in the rotor. Each of the slots receives a pumping element which is spring urged toward engagement with the cam surface as the rotor is rotated relative to the cam surface. Each rotor slot defines a spring receiving recess extending from one major side surface of the rotor to a location between the major side surfaces of the rotor. The recess allows axial movement of a portion of the spring in one axial direction and blocks axial movement of that portion of the spring in the other axial direction. Each pumping element preferably defines a spring receiving recess which allows axial movement of another portion of the spring in the opposite axial direction and blocks movement of the spring in the one axial direction. The spring recesses facilitate assembly of the hydraulic device and resist undesirable spring movements during operation of the device.

13 Claims, 6 Drawing Figures

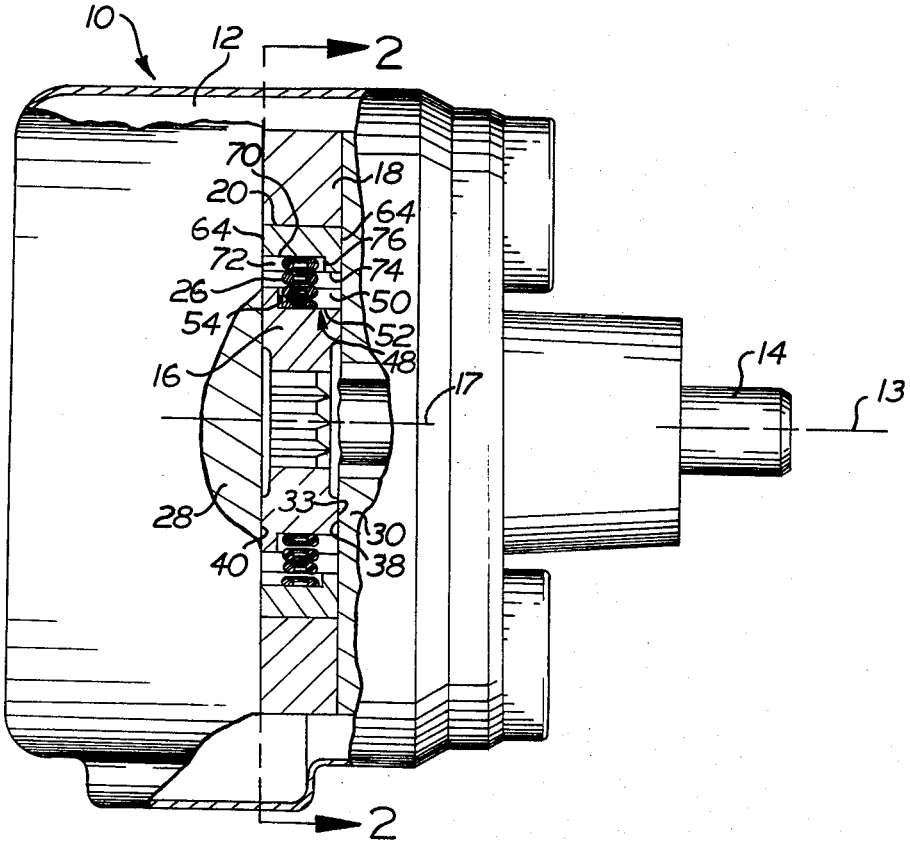
FIG. 1
FIG. 6
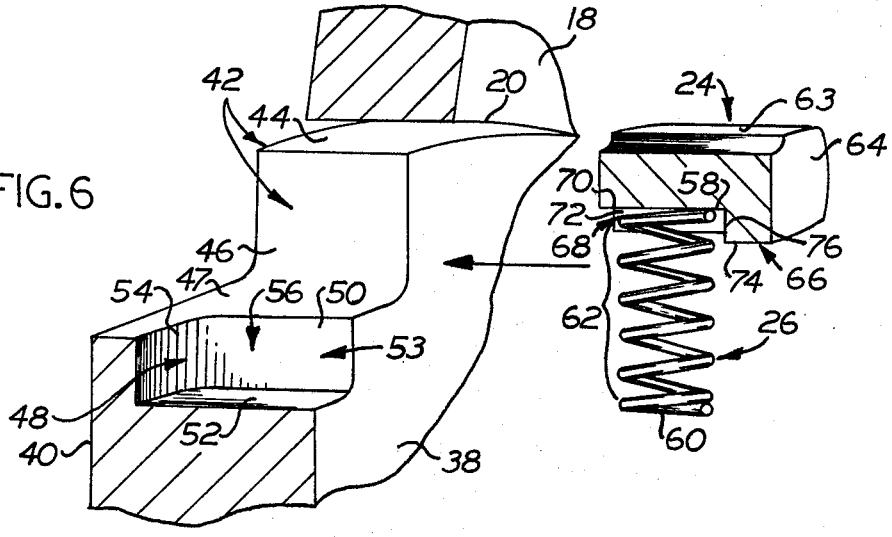

ROTARY HYDRAULIC DEVICE WITH RETAINING MEANS FOR PUMPING ELEMENT BIASING SPRINGS

BACKGROUND OF THE INVENTION

This application relates generally to hydraulic devices of the type in which a series of pumping elements are carried by slots in a rotor and are spring urged toward engagement with a circumscribing cam ring. It relates particularly to a hydraulic device of the type in which the configuration of the rotor and/or the pumping elements serves to positively restrict undesirable spring movements of the type which might damage the springs or make the device unduly noisy.

In hydraulic devices of the type in which the pumping elements are formed by slippers which can move radially and rock angularly with respect to the rotor it is known that a spring helps to assure positive engagement of the slipper and the cam ring at low rotational speeds. Examples of such slipper-type hydraulic devices can be found in disclosures such as U.S. Pat. Nos. 2,641,195; 3,403,630; 3,645,647 and 3,797,977. Examples of other types of hydraulic devices in which a pumping element is spring biased toward engagement with a cam ring can be found in disclosures such as U.S. Pat. Nos. 3,223,044; 3,716,033 and 3,765,379.

In hydraulic devices of the slipper-type, two basic design techniques have been used to provide for resisting undesirable spring movement. One technique is to provide either a rotor slot or its associated slipper, or both, with a hole for receiving an end portion of the spring (which is usually a helical spring). When the rotor and pumping elements are molded of powdered metal, this technique requires that the holes be drilled into the rotor and/or pumping element.

Another technique for providing for resisting spring movement has been to provide the rotor or pumping element with a protrusion which extends into a portion of the helical spring.

SUMMARY OF THE INVENTION

The present invention provides a hydraulic device in which the configuration of the rotor and pumping element combine to resist undersirable movement of the associated spring during operation of the device.

The present invention further provides a hydraulic device in which the pumping element and rotor configuration is designed to facilitate assembly of the hydraulic device.

The present invention also provides a hydraulic device in which the rotor and pumping element can be molded into their spring retaining shapes, thus making them inexpensive to manufacture.

The present invention further relates to a hydraulic device having a rotor which is particularly configured to retain a portion of a spring means against dislodgement through one major side of the rotor, while allowing free access to the spring means through the other major side of the rotor, thereby facilitating assembly of the hydraulic device.

BRIEF DESCRIPTION OF THE DRAWINGS

The further advantages of this invention will become further apparent from the following detailed description taken with reference to the accompanying drawings wherein:

FIG. 1 is a side view of a hydraulic device with portions broken away and illustrating a rotor and pumping elements constructed according to the principles of the invention;

FIG. 6 is a fragmentary partially exploded pictorial illustration of a portion of the rotor and associated pumping element.

DETAILED DESCRIPTION OF THE PREFERRED EMBODIMENT

Figure 2:
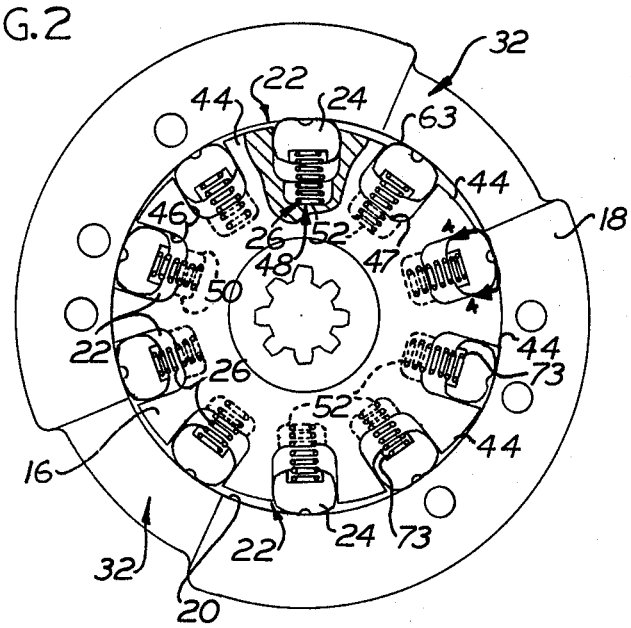
FIG. 2 is a sectional view of the hydraulic device of FIG. 1, taken from the direction 2—2, with portions omitted.

As set forth above the present invention relates to a hydraulic device of the type in which a rotor is circumscribed by a cam surface and the rotor includes at least one spring biased pumping element which is urged toward engagement with the cam surface as the rotor moves relative to the cam surface. The principles of the invention are described hereinafter as they relate to a hydraulic device of the slipper-type and intended to function as a pump. However, from the description which follows, the manner in which the principles of the invention may be applied to various comparable hydraulic devices designed to function as pumps or motors will become readily apparent to those of ordinary skill in the art. Accordingly, the term "pumping element" is utilized herein to refer to an element of either a pump or motor.

Referring to FIG. 1, the pump includes an outer housing 10 which defines a fluid chamber 12 interiorly thereof. A driven shaft 14 is supported for rotation about a central axis 13 thereof. Shaft 14 extends into the chamber 12 and its inner end has a splined connection to a rotor 16. Rotation of shaft 14 rotates rotor 16 about the central axis 17 of the rotor. A cam ring 18 includes a bore 20 which defines a cam surface which circumscribes the rotor 16.

In the illustrated embodiment the rotor 16 includes a plurality of peripheral slots 22 (FIG. 2), and a pumping element 24 is disposed in each slot. A spring 26 is compressed between each pumping element 24 and the rotor. The pumping element 24 is free to move radially in the slot 22 and the spring urges the pumping element into engagement with cam surface 20 as the rotor is rotated relative to the cam surface. The spring is also designed to allow the pumping element 24 to rock angularly as it follows the shape of the cam surface.

The rotor 16 and cam ring 18 are disposed between an upper pressure plate 28 (FIG. 1) and a lower pressure plate 30 and cooperate therewith to define a series of fluid chambers which are expanded and contracted as the rotor is rotated. The present invention relates to certain aspects of the geometry of the rotor and pumping elements, as described more fully hereinafter. As seen in FIG. 2 each axial side of the cam ring 18 may also include a pair of recesses 32 which each form part of the inlet port. The further details of the pump may incorporate any appropriate well known pump characteristics which have been suggested for slipper-type pumps. For example, specifics of the shape of the cam surface, and of the location of the inlet and outlet ports for directing fluid to and from the expanding and contracting chambers may be designed in order to provide a porting plate and pumping chamber configuration having an optimum slipper seal and porting configuration. This can be achieved through a porting plate arrangement designed in accordance with the principles of U.S. patent application Ser. No. 520,497. It is also contemplated that the pump may be provided with a design which provides for axially loading and unloading the upper pressure plate 28 in accordance with the principles of U.S. Pat. No. 3,822,965.

The rotor 16 includes major side surfaces 38 and 40 (FIG. 1) which are disposed adjacent the lower and upper pressure plates 30, 28 respectively. The rotor also has a minor side surface 42 which intersects both major side surfaces. Minor surface 42 defines an outer series of arcuate portions 44 (FIG. 2) which are arcs of a circle having a center of curvature coinciding with the central axis of the rotor. The slots 22 are defined by parallel side surfaces 46 and a bottom surface 47.

In accordance with the invention, the rotor 16 includes surfaces defining a radially outwardly open recess 48 at the bottom of each of the slots 22. Each of the recesses 48 extends from one major side surface to a location between the major side surfaces of the rotor. In the illustrated embodiment, rotor recess 48 extends from major side surface 38 to a location between the major side surfaces 38, 40.

Figure 3:
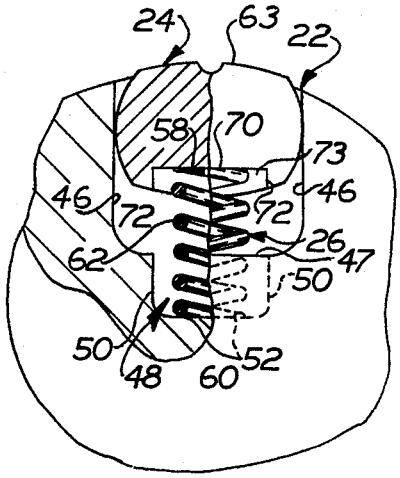
FIG. 3 is an enlarged view of a portion of the rotor and a single pumping element constructed according to the principles of the invention, with portions of the elements illustrated in sectional view.

Each rotor recess 48 includes a pair of side surface areas 50 (FIG. 3) which are spaced apart and which are preferably parallel to each other. Both side surface areas 50 are connected with a bottom surface area 52, and both side surfaces 50 and bottom surface area 52 intersect major side surface 38 to define an open end 53 (FIG. 6) of the recess 48. As seen in FIG. 2, each bottom surface area 52 is normal to a line extending radially through the center of the rotor.

An end surface area 54 (FIGS. 1 and 6) is disposed between the major side surface areas 38, 40 of the rotor and intersects both the side surface areas 50 and the bottom surface area 52. In addition, the end surface area 54 and the side surface areas 50 are normal, that is perpendicular, to bottom surface area 52 and extend between the bottom surface area 52 and the bottom surface 47 of the associated slot 22 to form an open side 56 of the recess 48. The open side 56 of the recess 48 faces outwardly toward the cam ring 18.

Figure 4:
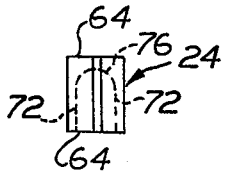
FIG. 4 is a top view of a pumping element constructed according to the principles of the invention, taken from the direction 4—4 in FIG. 2.
Figure 5:
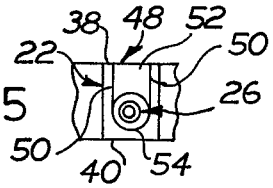
FIG. 5 is a full line view of a rotor recess of FIG. 2, taken from the direction 4—4, and with the pumping element omitted.

A spring 26 is associated with each pumping element 24. Each spring 26 is preferably a helical spring, and includes an outer end portion 58 (FIG. 3) which engages the pumping element 24 and inner end portion 60 disposed in engagement with the bottom surface 52 of the recess at a location adjacent to end surface 54 of the recess. An intermediate portion 62 of the spring extends between the outer end portion 58 and the inner end portion 60. A portion of the intermediate portion of the spring is disposed between the side surface areas 50 of the recess 48 at the bottom of the associated slot 22. The open end 53 (FIG. 6) of the recess 48 provides a passage which allows axial movement of the spring in the opposite axial direction relative to the rotor, and the end surface area 54 blocks axial movement of the spring in the opposite axial direction, thus resisting movement of that portion of the spring in one axial direction. As seen particularly in FIGS. 4 and 5, the end surface area 54 is preferably arcuately shaped and has a radius of curvature which is slightly larger than the radius of curvature of the outer surface of the coils of the helical spring 26.

Each pumping element 24 includes a face surface 63 which is urged into engagement with the cam surface 20 as the rotor rotates relative to the cam surface. The face surface 63 can be designed in any known manner. In the illustrated embodiment of the invention, the face surface 63 has a configuration similar to the configuration illustrated in U.S. Pat. No. 3,797,977.

Each pumping element further defines major side portions 64 which extend inwardly from the face surface 63 and in a direction toward the axis of rotation of the rotor 16. When a pumping element 24 and the rotor 16 are in assembled condition each of the major side portions 64 of the rotor is disposed generally adjacent a respective one of the major side surfaces 38, 40 of the rotor.

Each pumping element 24 includes an inner portion 66 (FIG. 6) which extends between the major side portions of the pumping element. The inner portion defines a radially inwardly open recess 68 extending from one major side 64 of the pumping element to a location between the parallel major sides 64 of the pumping element. The inner portion includes a flat rectangular inner bottom surface area 70 and a pair of flat parallel inner side surface areas 72 connected with and extending perpendicular to the inner surface 70. The side surface areas 72 and bottom surface area 70 intersects the major sides 64 of the pumping element which is disposed adjacent the major side surface 40 of the rotor to define a side opening 73 of the recess 68. The pumping element recess side opening 73 faces in the opposite direction from the open end of the rotor recess 48. The inner portion of the pumping element further includes a bottom surface area 74 and end surface area 76 disposed between the side surface areas 72 and intersecting the bottom surface area 74 to define an open bottom of the pumping element.

The outer end portion 58 of the spring is preferably disposed in engagement with the inner surface area 70 of the pumping element and at a location adjacent to the end surface area 76. A portion of the intermediate portion of the spring is disposed between the side surface areas 72 of the pumping element. The open end of the pumping element recess 68 provides a passage which allows axial movement of the portion of the spring in an axial direction and end surface area 76 blocks axial movement of that portion of the spring in the opposite axial direction. The end surface area 76 of the pumping element is preferably arcuately shaped and has a radius of curvature which is greater than the diameter of the outer surface area of the coils of the helical spring 26 and the side surface areas 72 are preferably parallel to each other and spaced apart by a distance which is greater than the diameter of the helical spring. As seen in FIG. 1, the end surface area 76 of each pumping element is disposed radially outward of the surface area 54 of the associated rotor recess.

With the rotor, springs and pumping elements assembled in the manner set forth above, each spring urges the face surface 63 of the respective pumping element into engagement with cam surface 20 while also allowing the pumping element to rock angularly. One end of the spring is contained against axial movement in one direction relative to the rotor axis and the other end of the spring is contained against axial movement in the opposite axial direction, thereby serving to contain the spring against movement which might tend to cause undesirable noise and which might damage the spring or other elements.

In assembling a hydraulic device having a rotor and a pumping element constructed according to the foregoing description the rotor is generally positioned against the pressure plate 28 and with rotor recess 48 disposed with its open end opening toward major side surface 38. Each pumping element and its associated spring are then preassembled to the configuration illustrated in FIG. 6 with the pumping element oriented with its recess opening toward the major side surface 40 of the rotor. The spring is compressed and the combined pumping element and spring are inserted axially into the appropriate slot 22 as shown by the arrow in FIG. 6.

The rotor recess 48 enables axial movement of the spring 26 to occur in the direction of the arrow in FIG. 6 until the spring engages surface 54 defining the recess. When the pumping element has been disposed in alignment with the rotor and the lower pressure plate 30 placed in position, the end surface area 76 of the pumping element recess serves to constrain the radially outer portion of the spring from movement in a direction opposite the direction indicated by the arrow in FIG. 6.

A rotor having the construction set forth can be molded out of powdered metal. Similarly, each slipper can be molded out of powdered metal. This is believed to be extremely beneficial from a cost point of view. It is also contemplated that if desired the above-described rotor recess and pumping element recess could also be machined into the rotor and pumping elements at a higher cost.

With the foregoing description in mind, many and varied modifications of the principles of this invention will become apparent to those of ordinary skill in the art.

What is claimed is:

1. A hydraulic device comprising a rotor having a central axis and defining a pair of major side surfaces disposed normal to said central axis and an outer portion joining said major side surfaces, a cam surface circumscribing said rotor, said cam surface and said rotor being adapted for relative movement about said central axis of said rotor, said rotor including a series of circumferentially spaced slots, a pumping element being movable in each of said slots, a spring member associated with each of said pumping elements in its respective slot and adapted to apply a force to the pumping element for urging the pumping element toward engagement with the cam surface and supporting said pumping element for rocking movement in following the contour of the cam surface, each pumping element comprising means defining an inner surface area in engagement with a first end portion of a respective spring, each pumping element further defining surface means for blocking axial movement of a first portion of the respective spring in one axial direction relative to said rotor and allowing axial movement of the portion of the respective spring in the opposite axial direction, each of the circumferentially spaced slots in the rotor defining a bottom surface area in engagement with a second end portion of the respective spring, each of the slots further defining surface means for blocking axial movement of a second portion of the respective spring in the axial direction which is opposite to the said one axial direction relative to the rotor and means for allowing axial movement of the second portion of the spring in the said one axial direction relative to the rotor.

2. A hydraulic device as defined in claim 1 wherein each spring member comprises a longitudinally extending helical spring, said helical spring comprising longitudinal first and second ends in respective engagement with the inner surface area of the associated pumping element and the bottom surface area of the associated slot in the rotor, each pumping element defining arcuate surface means in facing relation to a predetermined portion of the outer periphery of the associated helical spring for blocking movement of said helical spring in said first axial direction, and each associated slot including means defining an arcuate surface means in facing relationship with a predetermined arcuate portion of said associated spring for blocking movement of said spring in a direction opposite to said first direction.

3. A hydraulic device as defined in claim 1 wherein each slot of said rotor comprises a flat bottom surface disposed generally normal to the radius of said rotor, each slot further defining a surface extending generally radially outward of the associated flat bottom surface and including an arcuate surface portion disposed in generally concave relationship with one axial side of said rotor, each slipper comprising means defining a substantially flat inner surface area disposed in substantially facing relation to said substantially flat bottom surface of said associated slot, each pumping element further defining an arcuate surface portion extending generally inward of said flat inner surface and disposed in a generally concave relationship with the other axial side of said rotor.

4. A hydraulic device as set forth in claim 1 wherein said rotor comprises a molded powdered metal article defining each of said radially oriented slots, and each of the pumping elements comprises a molded powdered metal article defining said inner surface area and said blocking surface means.

5. A hydraulic device as defined in claim 4 wherein each of said pumping elements comprises a molded powder metal article and wherein said rotor comprises a molded powder metal article.

6. A hydraulic device comprising a rotatable rotor having first and second major sides and an arcuate minor side extending between said major sides, a cam surface circumscribing said rotor, first surface means on said rotor defining a slot extending inwardly from the first major side of said rotor to a first end surface disposed between the major sides of said rotor, a pumping element, said pumping element having a first side surface which is disposed adjacent to the first major side of said rotor and a second side surface which is disposed adjacent to the second major side of said rotor, said first and second side surfaces of said pumping element being interconnected by a face surface area which is at least partially disposed in engagement with said cam surface, second surface means on said pumping element defining a slot extending inwardly from the second side surface of said pumping element to a second end surface disposed between the side surfaces of said pumping element, and spring means for urging said pumping element toward said cam surface, said spring means having an outer end portion disposed in said slot in said pumping element and an inner end portion disposed in said slot in said rotor, said end surfaces of said pumping element and rotor slots facing toward each other to enable said end surface of said rotor slot to block movement of said spring means toward said second major side of said rotor and to enable said end surface of said pumping element slot to block movement of said spring means toward said first major side of said rotor.

7. A hydraulic device as set forth in claim 6 wherein said rotor further includes surface means for defining a recess having a bottom and sides extending between the major sides of said rotor, said pumping element being at least partially disposed in said recess, said slot in said rotor extending from the bottom of said recess toward the axis of rotation of said rotor, said slot in said rotor having a cross-sectional area in a plane extending parallel to the major sides of said rotor which is less than the cross-sectional area of said recess in the plane extending parallel to the major sides of said rotor.

8. A hydraulic device comprising a rotor having a pair of major sides and an arcuate minor side joining said major sides, a cam surface circumscribing said rotor, surface means on said rotor defining a radially outwardly open rotor recess extending from one major side of said rotor to a location between the major sides of the rotor, said surface means defining said rotor recess including spaced apart side surface areas connected with a bottom surface area, said side and bottom surface areas of said recess intersecting one of said major sides of said rotor to at least partially define an open end of said recess, said rotor recess further including an end surface area disposed between said major sides of said rotor and intersecting said side and bottom surface areas of said recess to form an inner end of said recess, said side and end surface areas of said recess extending between said bottom surface area of said recess and said minor side of said rotor to at least partially define an open side of said recess, a pumping element at least partially disposed in said recess in said rotor and having a face surface area with is at least partially disposed in engagement with said cam surface, said pumping element including a pair of outer side surfaces disposed adjacent the major side surfaces of the rotor and extending inwardly from said face surface in a direction toward the axis of rotation of said rotor and an inner portion extending between said outer side surfaces of said pumping element, said inner portion defining a recess extending from an opening in one outer side surface of said pumping element to a location between the outer side surfaces of said pumping element, said recess in said pumping element including an inner bottom surface area and a pair of inner side surface areas connected with the inner bottom surface area and intersecting an outer side surface of the pumping element which is disposed adjacent the major side of the rotor opposite from said one major side of the rotor to at least partially define the recess opening in the outer side surface of said pumping element, said recess further including an end surface area disposed between said outer side surfaces and intersecting said inner bottom surface area and said inner side surface areas to define a bottom side opening in said pumping element facing toward said rotor, said inner portion of said pumping element further including an outer bottom surface area disposed outwardly of said inner bottom surface area of said recess and extending between said end surface and one of said outer side surfaces, and spring means for urging said pumping element toward said cam surface, said spring means having an outer end portion disposed in engagement with said pumping element and an inner end portion disposed in engagement with said bottom surface area of said rotor recess, said spring means having an intermediate portion extending between said inner and said outer end portions, said intermediate portion of said spring means being at least partially disposed between said side surface areas of said rotor recess, said outer end portion of said spring means being disposed in engagement with said inner bottom surface area of the recess in said pumping element at a location adjacent to said end surface area of said recess in said pumping element, said intermediate portion of said spring means being disposed between said inner side surface areas of the recess in said pumping element.

9. A hydraulic device as defined in claim 8 wherein said bottom surface area of said rotor recess includes a flat surface disposed generally normal to the radial direction of said rotor, said side surface areas of said rotor recess including parallel surfaces disposed generally normal to said bottom surface of said rotor recess and said end surface area of said rotor recess comprising an arcuate surface portion disposed generally normal to said bottom surface area of said rotor recess.

10. A hydraulic device as defined in claim 8 wherein said rotor is formed as a molded powder metal article.

11. A hydraulic device as defined in claim 8 wherein said end surface area of the recess in said pumping element is disposed radially outwardly of and offset from said end surface area of said rotor recess.

12. A hydraulic device as defined in claim 11 wherein said spring means comprises a helical spring, said end surface area of the recess in said rotor defining an arcuate portion having a radius of curvature which is greater than the radius of curvature of a radially outer surface area of said helical spring, and wherein said end surface area of the recess in said pumping element includes an arcuate portion having a radius of curvature which is greater than the radius of curvature of the radially outer surface area of said helical spring.

13. A hydraulic device as defined in claim 12 wherein said side surface areas of the recess in said rotor are parallel to each other, and wherein said side surface areas of the recess in said pumping element are parallel to each other.

* * * * *